US010001725B2

(12) United States Patent
Van de Straete et al.

(10) Patent No.: US 10,001,725 B2
(45) Date of Patent: Jun. 19, 2018

(54) DEVELOPING UNIT WITH IMPROVED CONVEYING ASSEMBLY

(71) Applicant: Xeikon Manufacturing N.V., Lier (BE)

(72) Inventors: Herman Jan Godelieve Van de Straete, Deurne (BE); Bart Jozef Van Dessel, Zoersel (BE)

(73) Assignee: Xeikon Manufacturing N.V., Lier (BE)

( * ) Notice: Subject to any disclaimer, the term of this patent is extended or adjusted under 35 U.S.C. 154(b) by 0 days. days.

(21) Appl. No.: 15/414,034

(22) Filed: Jan. 24, 2017

(65) Prior Publication Data

US 2017/0212451 A1 Jul. 27, 2017

(30) Foreign Application Priority Data

Jan. 25, 2016 (NL) ..... 2016148

(51) Int. Cl.
*G03G 15/08* (2006.01)

(52) U.S. Cl.
CPC . *G03G 15/0891* (2013.01); *G03G 2215/0819* (2013.01); *G03G 2215/0827* (2013.01); *G03G 2215/0833* (2013.01)

(58) Field of Classification Search
USPC ..... 399/111, 119, 252–259, 265–267, 276, 399/277
See application file for complete search history.

(56) References Cited

U.S. PATENT DOCUMENTS

| | | | | |
|---|---|---|---|---|
| 5,722,002 | A * | 2/1998 | Kikuta | G03G 15/0822 366/291 |
| 8,488,998 | B2 * | 7/2013 | Hayashi | G03G 15/0822 399/254 |
| 2004/0213603 | A1 | 10/2004 | Shigeta et al. | |
| 2006/0188273 | A1 | 8/2006 | Takesawa et al. | |
| 2009/0257781 | A1 | 10/2009 | Fuji | |

FOREIGN PATENT DOCUMENTS

| | | | |
|---|---|---|---|
| CN | 204150604 | U | 2/2015 |
| EP | 0671669 | A2 | 9/1995 |
| EP | 1857886 | A1 | 11/2007 |
| EP | 1942379 | A2 | 7/2008 |
| JP | 59136758 | A | 8/1984 |
| JP | 850406 | A | 2/1996 |

* cited by examiner

*Primary Examiner* — Hoan Tran
(74) *Attorney, Agent, or Firm* — The Webb Law Firm

(57) ABSTRACT

A developing unit configured for operating with a two-component developer material includes carrier particles to which the toner particles are adhered. The developing unit includes: at least one developer member rotatably mounted in the housing and configured for transferring toner particles to a photoconductor member, and a conveying assembly configured for conveying toner particles to the at least one developer member or away from the at least one developer member. The conveying assembly includes an auger and which includes a bar shaped shaft, a helical screw blade arranged around the shaft, and at least a first elongate element arranged at a distance of the shaft.

19 Claims, 7 Drawing Sheets

DEVELOPING UNIT WITH IMPROVED CONVEYING ASSEMBLY

CROSS-REFERENCE TO RELATED APPLICATION

This application claims priority to Dutch Patent Application No. 2016148 filed Jan. 25, 2016, the disclosure of which is hereby incorporated in its entirety by reference.

BACKGROUND OF THE INVENTION

Field of Invention

This invention relates to developing units for developing an electrostatic latent image. Particular embodiments relate to a developing unit for developing an electrostatic latent image with dry two-component developer material.

Description of Related Art

In electrophotographic printing machines an electrostatic charge image is formed on a dielectric recording member that may be a photoconductive dielectric recording member which, after being uniformly charged, is image-wise exposed to conductivity-increasing radiation, producing thereby a "direct" or "reversal" toner-developable charge pattern on the recording member.

Two component and single component developer materials are commonly used. A typical two component developer material comprises magnetic carrier particles having toner particles adhering thereto. A single component developer material typically comprises toner particles having an electrostatic charge so that they will be attracted to, and adhere to, the latent image on the photoconductive surface. The present invention is particularly useful for two component systems and hybrid systems using two component developer materials.

When a two-component developer material is used, toner particles are mixed with larger magnetizable carrier particles. The toner particles adhere to the magnetizable carrier particles by electrostatic attraction force. The electrostatic charge of the toner and carrier particles is obtained triboelectrically by agitation.

A developing unit applies the toner-carrier mixture to the surface carrying the electrostatic charge image, wherein toner and magnetizable carrier particles are mixed and a layer of the toner-carrier mixture, also referred to as developer material, is picked up by a developer member such as a rotating sleeve or drum having magnets inside, forming a so-called magnetic brush on magnetic roller. On rotating the magnetic roller, the toner particles still adhering to the magnetically attracted carrier particles are brought into a developing zone wherein the toner particles are separated from the carrier particles by the electrostatic attraction forces of the electrostatic latent image to be developed and transfer to the latent electrostatic charge image. A developing bias voltage of suitable polarity applied between the magnetic brush and the recording member to be developed may determine whether the development is a "direct" or "reversed" development.

The magnetic brush has to be supplied with fresh toner-carrier mixture. This is normally done by an agitator, e.g. a paddle wheel, projecting or scooping up toner-carrier mixture onto the magnetic brush from a housing holding the developer material. The partly exhausted developer is returned to the bulk of developer material contained in the housing and has to be thoroughly mixed timely with freshly added toner particles to keep the toner-carrier weight ratio within acceptable limits for obtaining consistent development results.

SUMMARY OF THE INVENTION

Embodiments of the invention aim to improve the mixing, conveying and developing properties of a developing unit, and in particular to improve the uniformity of the developer material within the developing unit, whilst at the same time keeping the developing unit compact. Particular embodiments aim to improve a developing unit using a two component developer material, and more in particular to obtain a more uniform toner particle concentration of the developer material.

According to a first aspect of the invention there is provided a developing unit comprising a housing having an inlet and an outlet; at least one developer member rotatably mounted in said housing and configured for transferring toner particles to a photoconductor member; and a conveying assembly configured for conveying toner particles to the at least one developer member or away from the at least one developer member. The conveying assembly comprises at least one supply conveying member rotatably mounted in said housing and configured for conveying toner particles from the inlet to the at least one developer member. The at least one supply conveying member comprises an auger and the auger comprises a bar shaped shaft, a helical screw blade arranged around said shaft, and at least a first elongate element arranged at a distance of said shaft. The conveying assembly further comprises a discharge conveying member rotatably mounted in said housing and configured for conveying toner particles from the at least one developer member to the outlet. The inlet and the outlet may be connected to a mixing and filling module where fresh toner particles are added to the developer material coming from the outlet of the housing. The mixture of used developer material with fresh toner particles may then be reintroduced in the housing via the inlet.

Embodiments are based inter alia on the inventive insight that by performing a simple adaption to a transport auger of the conveying assembly the developer material can be agitated and moved perpendicular to the transport direction of the auger during transport of the developer material from the inlet to the at least one developer member. In other words, the auger with the elongate element fulfills both an agitating function and a conveying function. This will lead to a more uniform concentration of toner particles in the developer material in the developing unit.

According to an exemplary embodiment the developing unit is configured for operating with a two-component developer material comprising carrier particles to which the toner particles are adhered, and wherein the at least one developer member comprises a magnetic brush comprising a rotating sleeve and at least one magnet member inside the rotating sleeve. When having to supply such at least one developer member with developer material, the adapted auger of the present invention will be particularly advantageous to improve the uniformity of the toner particle concentration, and hence the developing quality of the development unit.

In an exemplary embodiment the first elongate element is arranged against an outer edge of the helical screw blade. The first elongate element may be fixed to the outer edge by any suitable means or technique, e.g. by welding, by adhering, using mechanical attachment means, etc. Such an arrangement is particularly easy to implement as the first elongate element can be e.g. a straight rod which is adhered, e.g. welded in a number of points to the outer edge of a commercially available auger.

In another exemplary embodiment the first elongate element extends through the helical screw blade. This may be achieved by drilling holes in the helical screw blade and arranging a rod through the holes of the blade.

In an exemplary embodiment the first elongate element is arranged parallel to the shaft. In that way a straight elongate element may be used leading to a flow of the developer material in a lateral direction perpendicular on the axis of the shaft.

In an exemplary embodiment the first elongate element extends over at least 50 percent of the length of the helical screw blade. More preferably, the first elongate element extends over at least 80 percent of the entire length of the helical screw blade, and most preferably over at least 90 percent of the entire length of the helical screw blade. In that way the influence of the first elongate element can be easily achieved over a substantial part of the length of the auger.

In an exemplary embodiment a plurality of elongate elements are arranged at a distance of said shaft, and said plurality of elongate elements extends over at least 50 percent of the length of the helical screw blade, more preferably over at least 80 percent of the entire length of the helical screw blade, and most preferably over at least 90 percent of the entire length of the helical screw blade. In other words in such an embodiment the plurality of elongate elements covers a substantial part of the length of the auger.

In an exemplary embodiment a plurality of elongate elements are arranged at different distances of the shaft. This may further improve the operation of the auger, especially when there may be a variation in the material mass present in the auger.

In an exemplary embodiment the plurality of elongate elements is arranged parallel to the shaft.

In an exemplary embodiment an elongate element of the plurality of elongate elements is arranged either against an outer edge of the helical screw blade or it extends through the helical screw blade.

In an exemplary embodiment the discharge conveying member comprises a discharge auger arranged parallel to the at least one developer member. Preferably, the discharge auger is arranged such that it recuperates developer material from the developer member over its entire length. Preferably, the outlet is arranged at an end of the discharge auger. The outlet may be aligned with an axial direction of the discharge auger. Preferably, the discharge auger has a shaft and a helical screw blade with a variable pitch, wherein the pitch increases in the discharge direction of the discharge auger. Such an increasing pitch will lead to a more constant lateral filling flow of the auger over the length of the auger. Indeed, since the discharge auger is arranged parallel to the at least one developer member and recuperates developer material from the developer member over its entire length, the volume to be transported will increase in the discharge direction of the discharge auger.

In an exemplary embodiment the at least one supply conveying member comprises at least one paddle wheel arranged downstream of the auger with the first elongate element and upstream of the at least one developer member. This at least one paddle wheel will scoop or project the agitated developer material flow coming from the adapted auger in the direction of the at least one developer member.

In an exemplary embodiment the at least one supply conveying member comprises a first auger located parallel to and above the auger with the first elongate element. Preferably, the inlet is arranged at an end of the first auger such that the first auger receives toner particles flowing through the inlet. The inlet may be aligned with an axial direction of the first auger. Preferably, the first auger and the auger with the first elongate element rotate in the same direction. Preferably, a gutter with integrated cascade plate is located below the first auger, wherein said first auger is configured and arranged to transport toner from the inlet, over said cascade plate to said auger with the first elongate element. Preferably, the vertical distance between the top of the cascade plate and the bottom of a conveying space associated with the first auger decreases in the transport direction of the first auger. In an exemplary embodiment, the height of the cascade plate decreases in the transport direction of the first auger. In another embodiment, the cascade plate may have a horizontal top edge, and the first auger within its conveying space may be slightly inclined in the transport direction of the first auger. In that manner the adapted auger is provided over its entire length with a more or less constant flow flowing over the cascade plate, and the adapted auger will then create a suitable flow in the direction of the at least one developer member, optionally via one ore more paddle wheels.

In an exemplary embodiment the elongate element is a rectilinear elongate element, e.g. a straight rod. Such a straight rod may be fixed to the helical screw blade, preferably at an outer edge thereof.

In an exemplary embodiment the elongate element is a curved elongate element, preferably a helically curved rod. Such a curved rod may be fixed to the helical screw blade, preferably at an outer edge thereof. When the curved rod has the shape of a helix, the direction of the helix may be co-rotating or counter-rotating with respect to the direction of the helix of the helical screw blade. By having a counter-rotating direction it becomes possible to slightly reverse the flow, providing further flow optimization possibilities. Further the pitch of the helically curved rod may be constant or variable, depending on the desired flow properties. Preferably the pitch of the helically curved rod is at least two times, and more preferably at least three times, the pitch of the helical screw blade.

BRIEF DESCRIPTION OF THE DRAWINGS

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

DETAILED DESCRIPTION

Figure 1:
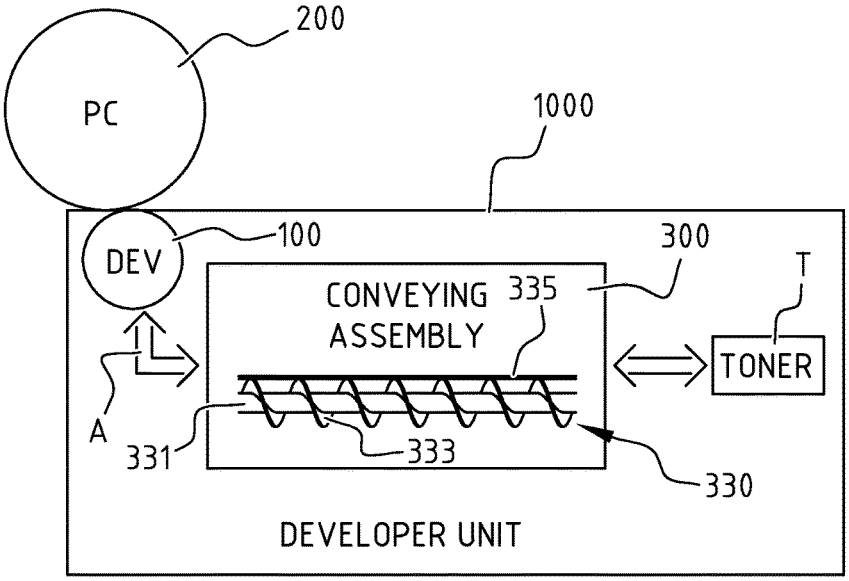
FIG. 1 illustrates schematically a developing unit of an exemplary embodiment.
Figure 2:
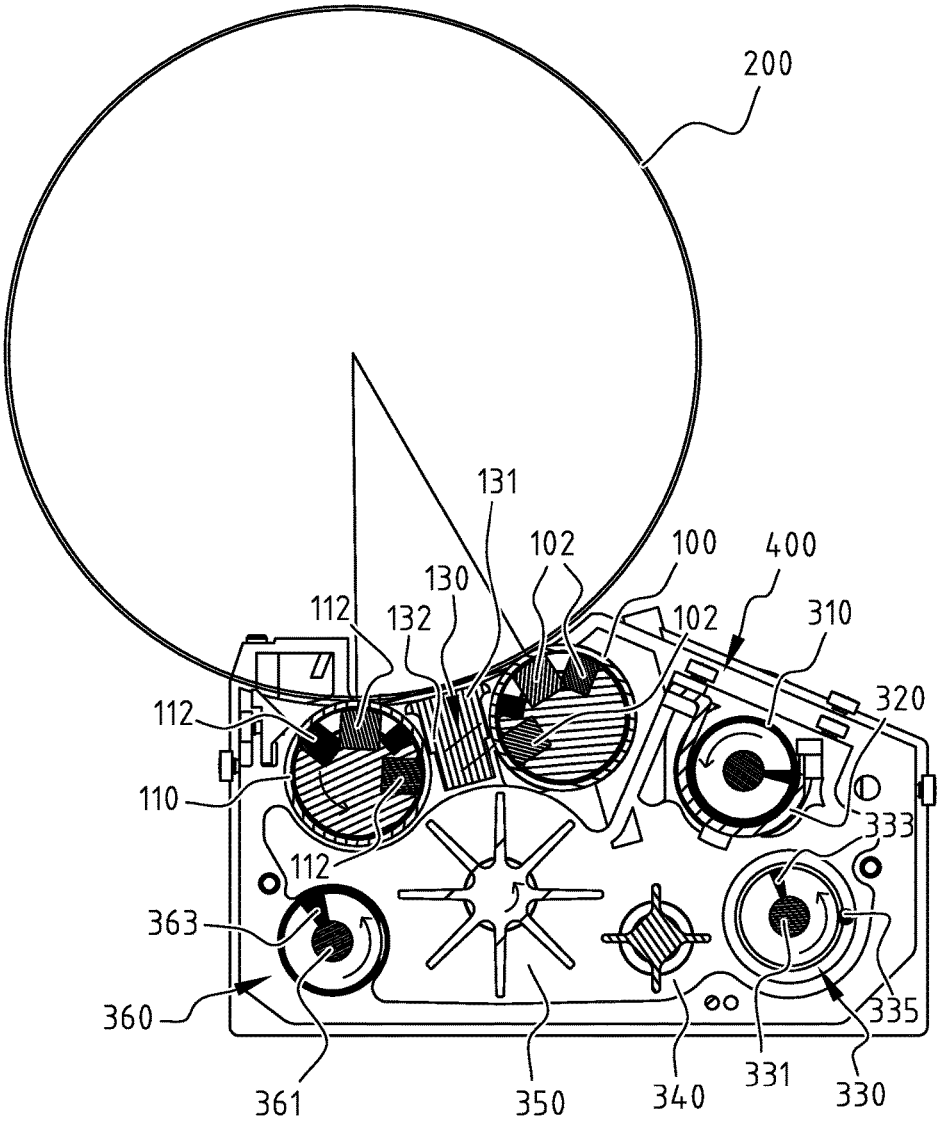
FIG. 2 illustrates a schematic cross section of a developing unit of an exemplary embodiment.
Figure 3A:
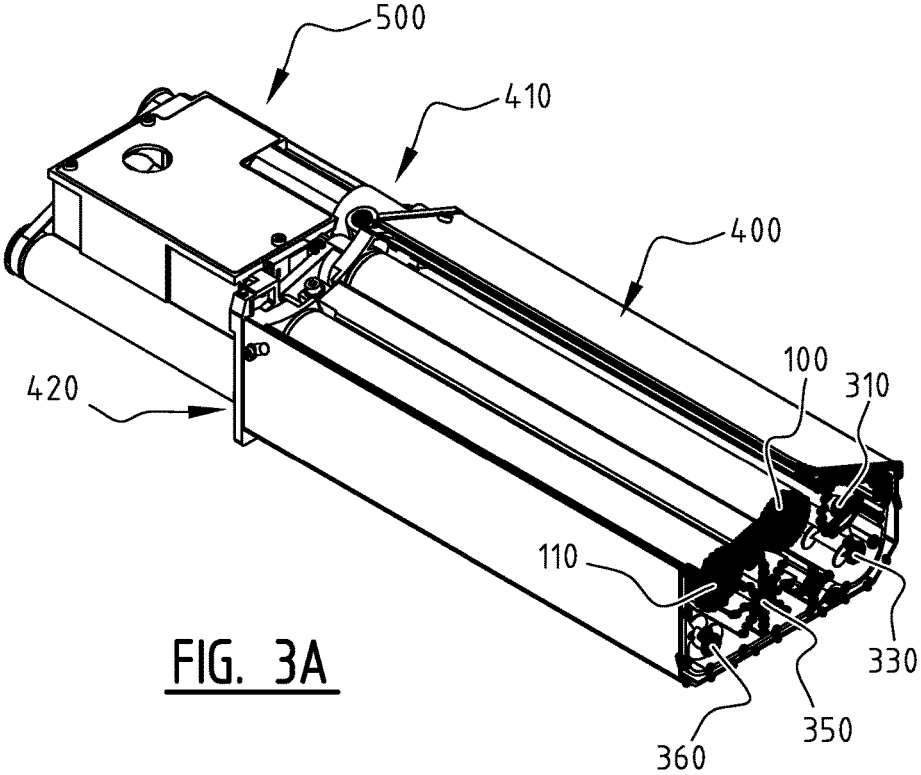
FIGS. 3A and 3B illustrate schematic perspective views of a portion of the developing unit of FIG. 2, with and without the housing, respectively, looking at the discharge side.
Figure 3B:
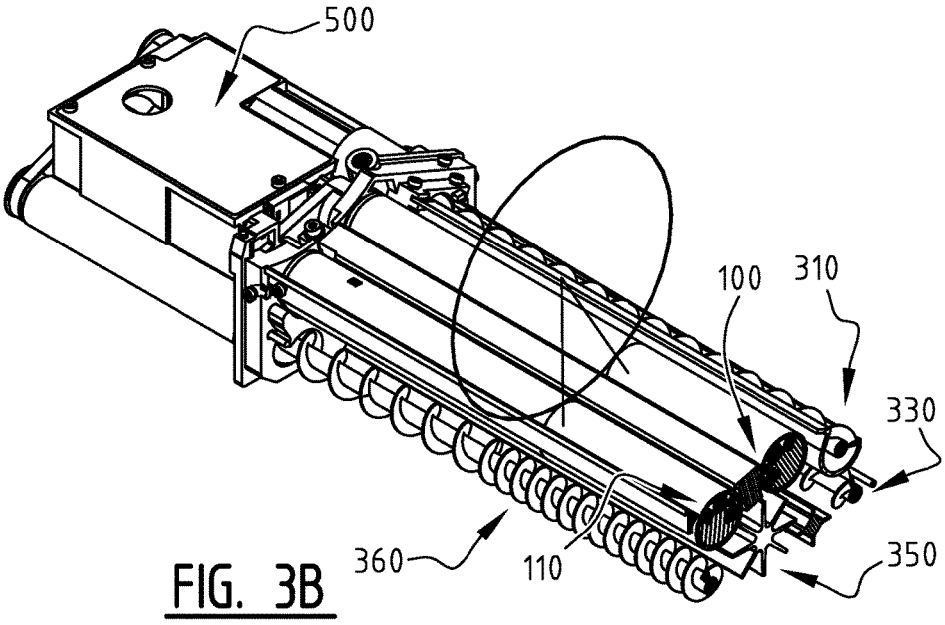
Figure 4:
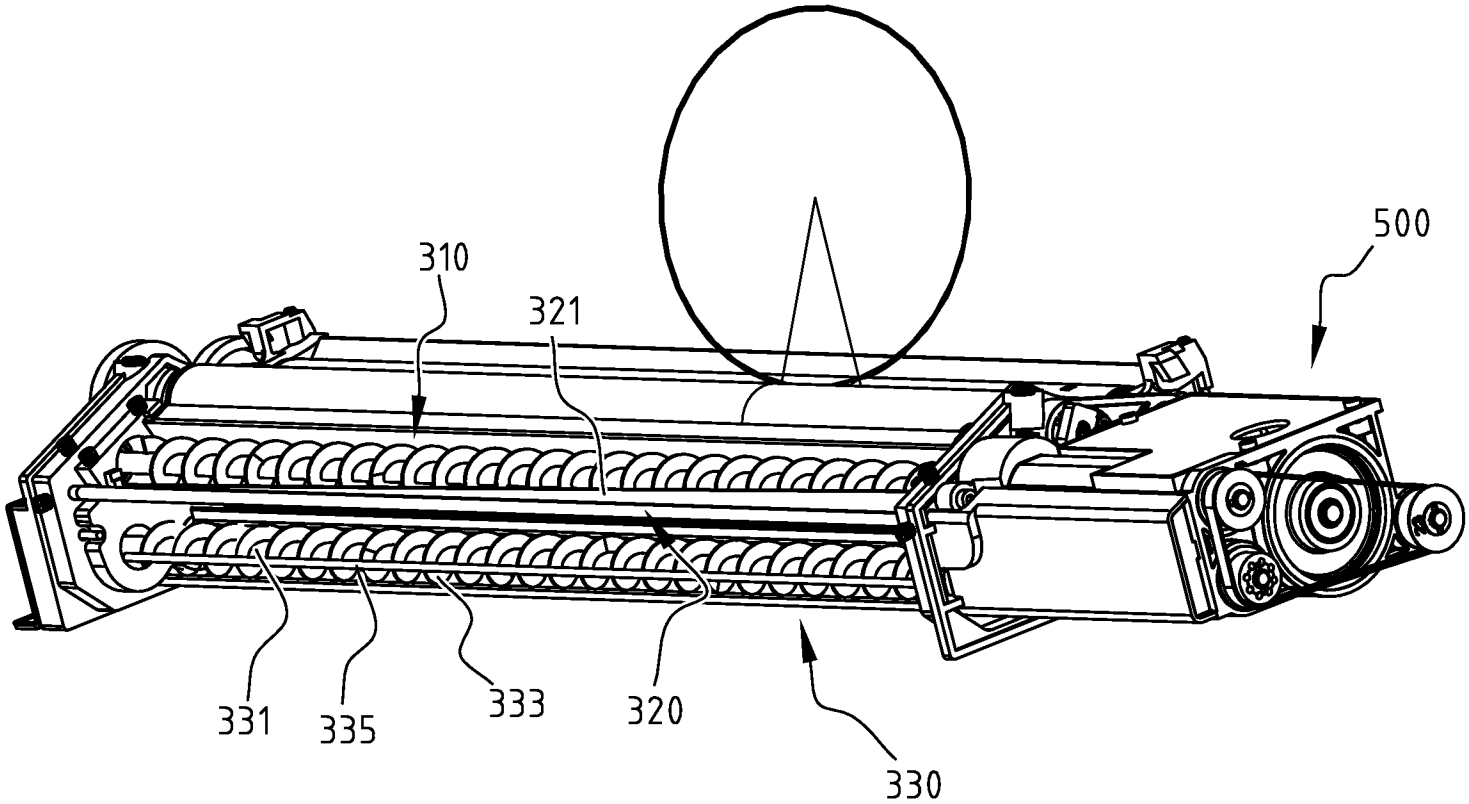
FIG. 4 illustrates a schematic perspective view of a toner filling unit of the developing unit of FIG. 2, without the housing, looking at the supply side.

FIG. 1 illustrates schematically a general exemplary embodiment of a developing unit 1000. The developing unit 1000 comprises a developer member 100 and a conveying assembly 300. Developer member (DEV) 100 is rotatably mounted and configured for transferring toner particles to a photoconductor (PC) member 200. Conveying assembly 300 is configured for conveying toner particles T to the developer member 100 or away from the developer member 100, see arrow A. Conveying assembly 300 comprises an adapted auger 330. Adapted auger 330 comprises a bar shaped shaft 331, a helical screw blade 333 arranged around shaft 331, and at least a first elongate element 335 arranged at a distance of shaft 331.

FIGS. 2, 3A, 3B and 4 illustrate an exemplary embodiment of a developing unit 1000 adapted for use with a two component developer material. The developing unit 1000 comprises a housing 400 in which a first developer member 100, a second developer member 110, and a conveying assembly 310, 320, 330, 340, 350, 360 is arranged. Developer members 100, 110 are rotatably mounted and configured for transferring toner particles to a photoconductor member 200. Developer members 100, 110 comprise a rotating sleeve or drum having magnetic members 112 inside, forming a so-called magnetic brush on magnetic roller.

For the illustrated embodiment within each magnetic development roller 100, 110 there is a stationary magnetic structure 112. The magnetic structure 112 is designed to remain in one position while the magnetic development roller 100, 110 rotates around it. The magnetic structure 112 includes any number of magnetic members 112 as necessary, and these magnetic members 112 may be in the form of discrete metal magnets, or areas of specific magnetic polarity within a continuous structure. The magnetic structure may also comprise electromagnets. The purpose of the magnetic structures 112 within magnetic development rolls 100, 110 is to attract the magnetic carrier particles from the developer material and cause the magnetic carrier particles to magnetically adhere to the surface of the magnetic development roller 100, 110 as a given portion of the surface of magnetic development roller 100, 110 is advanced towards the development zone. The operation with two-component developer material generally functions as follows: the carrier particles, attracted by the magnets 112 form filaments of a "magnetic brush". Toner particles adhere triboelectrically to the carrier particles. The magnetic brush of carrier particles thus serves to convey the toner particles to the development zone. Between the first developer member 100 and the second developer member 110 there is provided a metering member 130 including a first doctor blade 131 and a second doctor blade 132 for trimming a layer with a desired thickness such that a suitable amount of developer material is present in the development zone.

The conveying assembly comprises supply conveying members 310, 320, 330, 340, 350 and a discharge conveying member 360. Supply conveying members 310, 320, 330, 340, 350 are configured for conveying toner particles T from an inlet 410 of the housing 400 to the developer members 100, 110. Discharge conveying member 360 is configured to transport toner particles T from the developer members 100, 110 to an outlet 420 of the housing 400. Outlet 420 leads to a agitating and filling module 500 where additional toner particles T are added to the developer material and where the developer material is agitated.

Supply conveying members 310, 320, 330, 340, 350 comprise a first auger 310 associated with a gutter 320, an adapted auger 330, a first paddle wheel 340, and a second paddle wheel 350. First auger 310 is configured and arranged to transport toner particles T from inlet 410, over a cascade plate 321 of gutter 320 to adapted auger 330 which is located parallel to and below the first auger 310. Optionally first auger 310 may extend through the inlet 410 into the agitating and filling module 500. The height of the cascade plate 321 decreases in the transport direction of the first auger 310, see FIG. 4. First and second paddle wheels 340, 350 are arranged downstream of the adapted auger 330 and upstream of the developer members 100, 110.

Figure 5A:
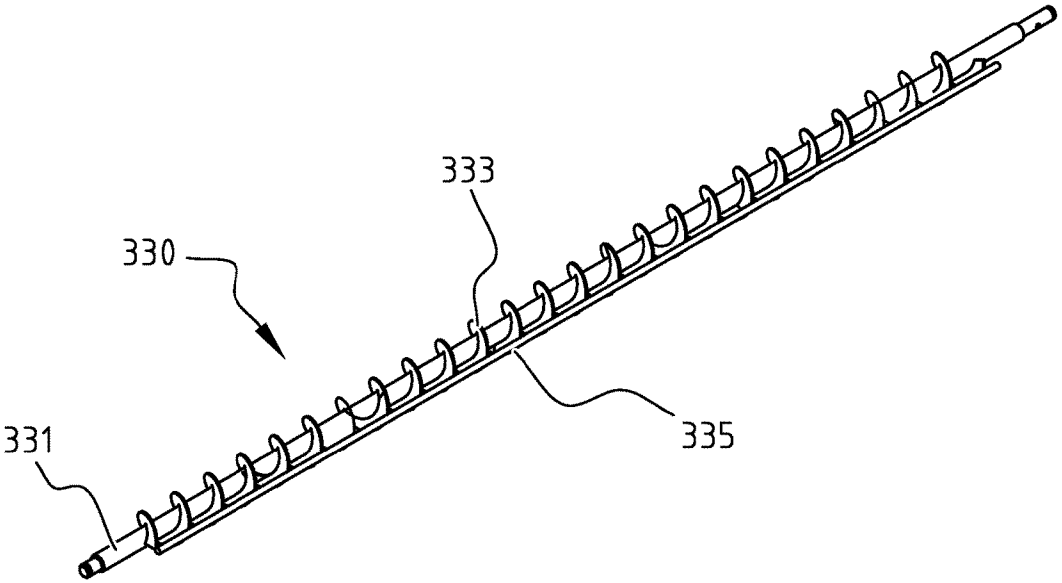
FIG. 5A and 5B illustrate a perspective view and a side view of an auger with an elongate element according to an exemplary embodiment, respectively.
Figure 5B:
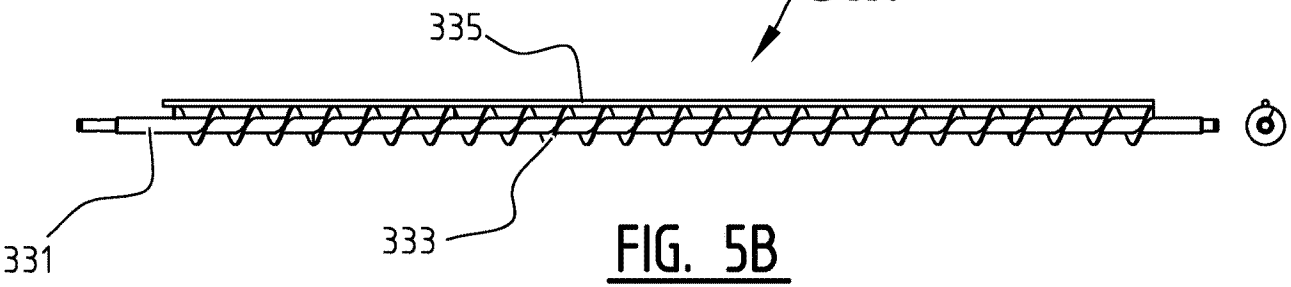

Adapted auger 330 comprises a bar shaped shaft 331, a helical screw blade 333 arranged around shaft 331, and at least a first elongate element 335 arranged at a distance of shaft 331, see also FIGS. 5A and 5B. The first elongate element 335 is arranged against an outer edge of the helical screw blade 335, and extends over at least 80 percent of the entire length of the helical screw blade 335, and preferably over substantially the entire length of the helical screw blade 335. The first elongate element 335 is arranged parallel to the shaft 331.

Figure 6A:
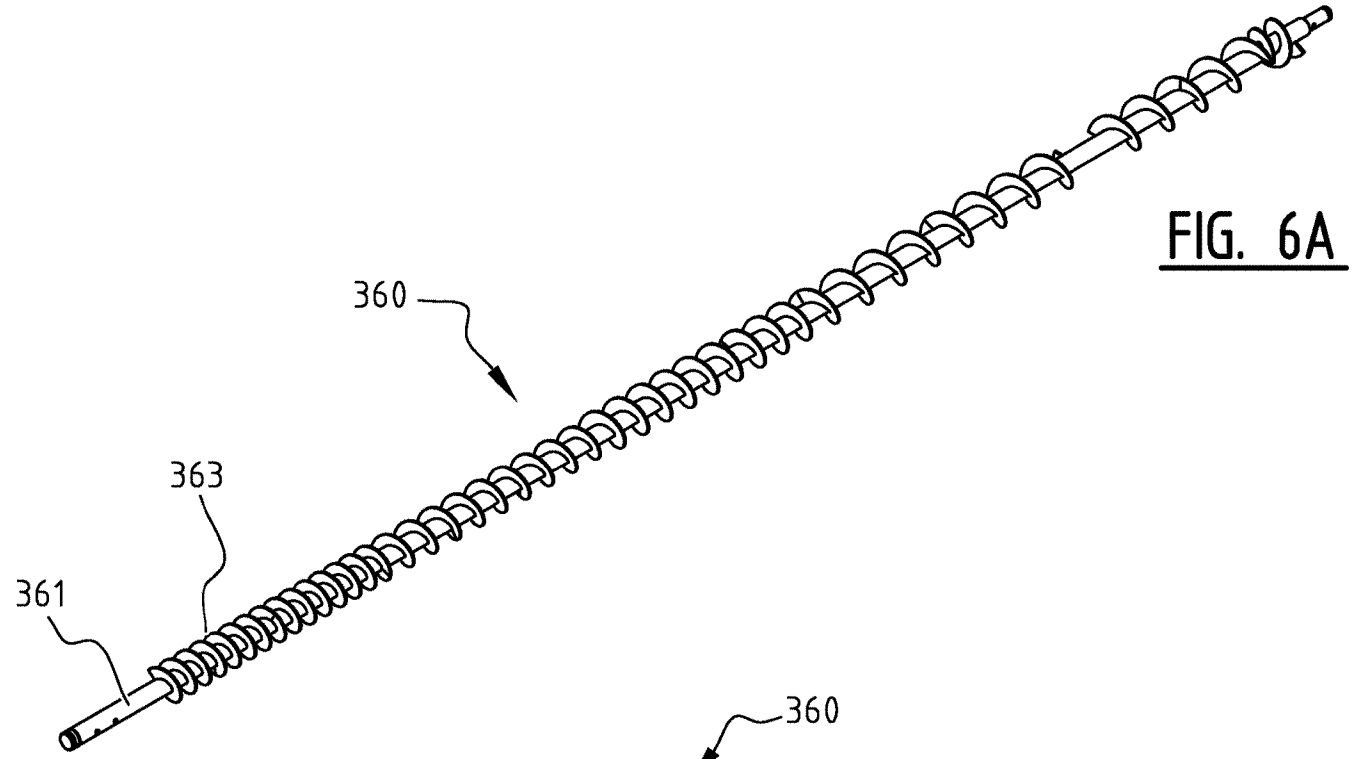
FIG. 6A and 6B illustrate a perspective view and a side view of an auger with a variable pitch according to an exemplary embodiment, respectively.
Figure 6B:
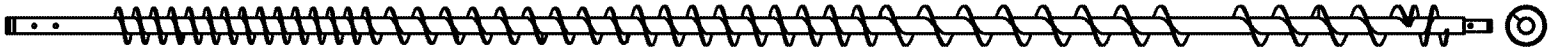

Discharge auger 360 comprises a shaft 361 and a helical screw blade 363 with a variable pitch, see also FIGS. 6A and 6B, wherein the pitch increases in the discharge direction of the discharge auger 360.

Figure 7A:
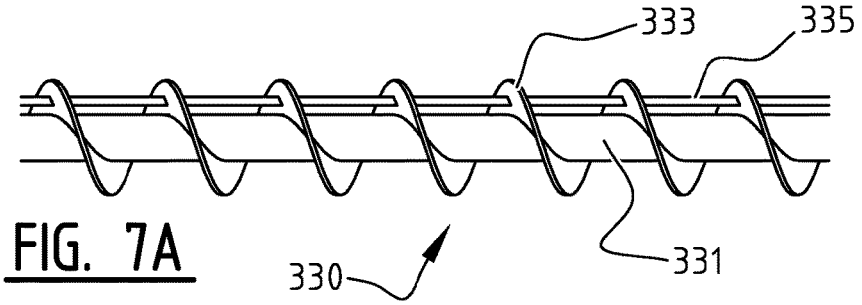
FIGS. 7A-7D illustrate other exemplary embodiments of an auger with an elongate element.

FIGS. 7A-7D illustrate other exemplary embodiments of an auger with an elongate element. FIG. 7A illustrates a side view of an adapted auger 330 comprising a bar shaped shaft 331, a helical screw blade 333 arranged around shaft 331, and a first elongate element 335 arranged at a distance of shaft 331. In this embodiment the first elongate element 335 extends through the helical screw blade 333.

Figure 7B:
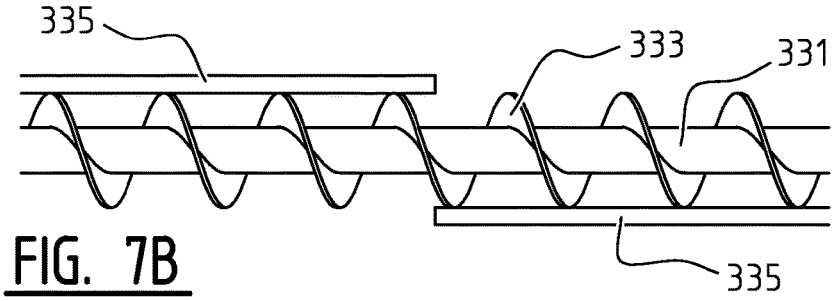

FIG. 7B illustrates a side view of an adapted auger 330 comprising a bar shaped shaft 331, a helical screw blade 333 arranged around shaft 331, and a plurality of elongate elements 335 arranged at a distance of shaft 331. In this embodiment the plurality of elongate elements 335 are fixed to an outer edge of the helical screw blade 333. In FIG. 7B two elongate elements 335 have been drawn but the skilled person understands that also more than two elongate elements may be provided. Preferably, the plurality of elongate elements 335 extends over at least 80 percent of the length of the helical screw blade 333.

Figure 7C:
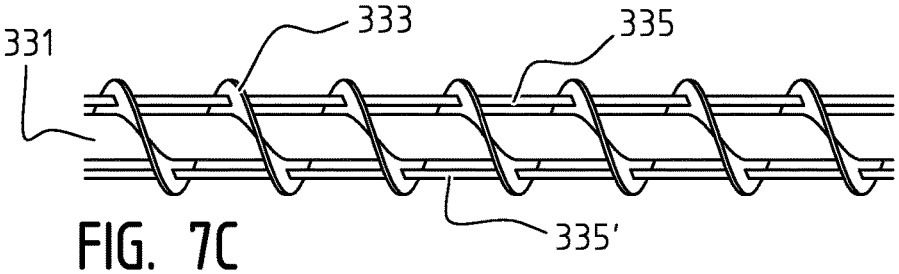

FIG. 7C illustrates a side view of an adapted auger 330 comprising a bar shaped shaft 331, a helical screw blade 333 arranged around shaft 331, and a plurality of parallel elongate elements 335, 335' arranged at a distance of shaft 331. In this embodiment the plurality of elongate elements 335 extend through the helical screw blade 333 but the skilled person understand that the plurality of elongate elements 335 may also be fixed to an outer edge of the helical screw blade 333. In FIG. 7C two elongate elements 335, 335' have been drawn but the skilled person understands that also more than two elongate elements may be provided.

Figure 7D:
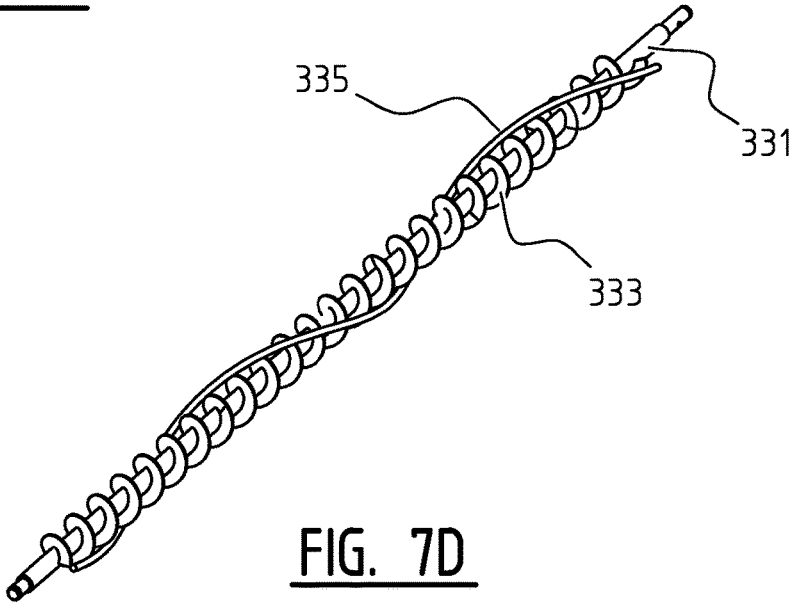

FIG. 7D illustrates a perspective view and a side view of an adapted auger 330 comprising a bar shaped shaft 331, a helical screw blade 333 arranged around shaft 331, and a curved elongate element 335 arranged at a distance of shaft 331. In this embodiment the elongate element 335 is a helically curved element fixed to an outer edge of the helical screw blade 333. In FIG. 7D one curved elongate element 335 has been drawn but the skilled person understands that also more than one elongate element may be provided. Also, instead of a constant pitch, the helically curved elongate element 335 may have a variable pitch in order to vary lateral flow speed. The direction of the helix of elongate element 335 may be co-rotating or counter-rotating with respect to the direction of the helix of the helical screw blade. By having a counter-rotating direction it becomes possible to slightly reverse the flow, providing further flow optimization possibilities. Preferably the pitch of the helically curved rod is at least two times, and more preferably at least three times, the pitch of the helical screw blade.

It should be appreciated by those skilled in the art that any block diagrams herein represent conceptual views of illustrative units or modules embodying the principles of the invention.

While the principles of the invention have been set out above in connection with specific embodiments, it is to be understood that this description is merely made by way of example and not as a limitation of the scope of protection which is determined by the appended claims.

The invention claimed is:

1. A developing unit configured for operating with a two-component developer material comprising carrier particles to which the toner particles are adhered; said developing unit comprising:

a housing having an inlet and an outlet for connection to a mixing and filling module;

at least one developer member rotatably mounted in said housing and configured for transferring toner particles to a photoconductor member;

a conveying assembly configured for conveying toner particles to the at least one developer member or away from the at least one developer member; wherein said conveying assembly comprises:

at least one supply conveying member rotatably mounted in said housing and configured for conveying toner particles from the inlet to the at least one developer member; said at least one supply conveying member comprising an auger, wherein said auger comprises a bar shaped shaft, a helical screw blade arranged around said shaft, and at least a first elongate element arranged at a distance of said shaft;

a discharge conveying member rotatably mounted in said housing and configured for conveying toner particles from the at least one developer member to the outlet;

wherein the at least one supply conveying member comprises a first auger located parallel to and above the auger with the first elongate element, said first auger being arranged to receive toner particles from the inlet.

2. The developing unit of claim 1, wherein the discharge conveying member comprises a discharge auger arranged parallel to the at least one developer member.

3. The developing unit of claim 2, wherein the outlet is aligned with an axial direction of the discharge auger.

4. The developing unit of claim 2, wherein the discharge auger has a shaft and a helical screw blade with a variable pitch, wherein the pitch increases in the discharge direction of the discharge conveying member.

5. The developing unit of claim 1, wherein the inlet is aligned with an axial direction of the first auger.

6. The developing unit of claim 1, wherein the first auger and the auger with the first elongate element rotate in the same direction.

7. The developing unit of claim 1, wherein a gutter with integrated cascade plate is located below the first auger, wherein said first auger is configured and arranged to transport toner from the inlet, over said cascade plate to said auger with the first elongate element.

8. The developing unit of claim 1, wherein the at least one developer member comprises a magnetic brush comprising a rotating sleeve and at least one magnet member inside the rotating sleeve.

9. The developing unit of claim 1, wherein the first elongate element is arranged against an outer edge of the helical screw blade; or wherein the first elongate element extends through the helical screw blade.

10. The developing unit of claim 1, wherein the first elongate element is arranged parallel to the shaft.

11. The developing unit of claim 1, wherein the first elongate element extends over at least 50 percent of the length of the helical screw blade, preferably at least 80 percent, and more preferably at least 90 percent.

12. The developing unit of claim 1, wherein a plurality of elongate elements are arranged at a distance of said shaft, and said plurality of elongate elements extends over at least 50 percent of the length of the helical screw blade, preferably at least 80 percent, and more preferably at least 90 percent; wherein optionally the plurality of elongate elements are arranged at different distances of the shaft; wherein optionally the plurality of elongate elements is arranged parallel to the shaft; wherein preferably an elongate element of the plurality of elongate elements is arranged against an outer edge of the helical screw blade or extends through the helical screw blade.

13. The developing unit of claim 1, wherein the elongate element is one of a rectilinear rod or a curved rod, preferably a helically curved rod.

14. A developing unit configured for operating with a two-component developer material comprising carrier particles to which the toner particles are adhered; said developing unit comprising:

a housing having an inlet and an outlet for connection to a mixing and filling module;

at least one developer member rotatably mounted in said housing and configured for transferring toner particles to a photoconductor member;

a conveying assembly configured for conveying toner particles to the at least one developer member or away from the at least one developer member; wherein said conveying assembly comprises:

at least one supply conveying member rotatably mounted in said housing and configured for conveying toner particles from the inlet to the at least one developer member; said at least one supply conveying member comprising an auger, wherein said auger comprises a bar shaped shaft, a helical screw blade arranged around said shaft, and at least a first elongate element arranged at a distance of said shaft;

a discharge conveying member rotatably mounted in said housing and configured for conveying toner particles from the at least one developer member to the outlet;

wherein the at least one supply conveying member comprises at least one paddle wheel arranged downstream of the auger with the first elongate element and upstream of the at least one developer member.

15. A developing unit configured for operating with a two-component developer material comprising carrier particles to which the toner particles are adhered; said developing unit comprising:

a housing having an inlet and an outlet for connection to a mixing and filling module;

at least one developer member rotatably mounted in said housing and configured for transferring toner particles to a photoconductor member;

a conveying assembly configured for conveying toner particles to the at least one developer member or away from the at least one developer member; wherein said conveying assembly comprises:

at least one supply conveying member rotatably mounted in said housing and configured for conveying toner particles from the inlet to the at least one developer member; said at least one supply conveying member comprising a first auger and a further auger, wherein said further auger comprises a bar shaped shaft, a helical screw blade arranged around said shaft, and at least a first elongate element arranged at a distance of said shaft; wherein said first auger is located parallel to and above the further auger with the first elongate element, said first auger being arranged to receive toner particles from the inlet; wherein the inlet is aligned with an axial direction of the first auger;

a discharge conveying member rotatably mounted in said housing and configured for conveying toner particles from the at least one developer member to the outlet; wherein the discharge conveying member comprises a discharge auger arranged parallel to the at least one developer member; wherein the outlet is aligned with an axial direction of the discharge auger.

16. The developing unit of claim 15, wherein the discharge auger has a shaft and a helical screw blade with a variable pitch, wherein the pitch increases in the discharge direction of the discharge conveying member.

17. The developing unit of claim 15, wherein the at least one supply conveying member comprises at least one paddle wheel arranged downstream of the further auger with the first elongate element and upstream of the at least one developer member.

18. The developing unit of claim 15, wherein the at least one developer member comprises a magnetic brush comprising a rotating sleeve and at least one magnet member inside the rotating sleeve.

19. The developing unit of claim 15, wherein the first elongate element is arranged parallel to the shaft.

* * * * *